US009399850B2

(12) United States Patent
Heichel et al.

(10) Patent No.: US 9,399,850 B2
(45) Date of Patent: Jul. 26, 2016

(54) DEVICE HAVING A HYDRAULIC DRIVE FOR CIVIL ENGINEERING

(75) Inventors: Christian Heichel, Niedernberg (DE); Albrecht Kleibl, Grossostheim (DE)

(73) Assignee: ABI Anlagentechnik-Baumaschinen-Industriebedarf Maschinefabrik und Vertriebsgesellschaft mbH, Niedernberg (DE)

( * ) Notice: Subject to any disclaimer, the term of this patent is extended or adjusted under 35 U.S.C. 154(b) by 525 days.

(21) Appl. No.: 13/571,710

(22) Filed: Aug. 10, 2012

(65) Prior Publication Data

US 2013/0036727 A1 Feb. 14, 2013

(30) Foreign Application Priority Data

Aug. 12, 2011 (EP) ..... 11006636

(51) Int. Cl.
*F15B 11/10* (2006.01)
*E02D 7/18* (2006.01)

(52) U.S. Cl.
CPC ..... *E02D 7/18* (2013.01)

(58) Field of Classification Search
None
See application file for complete search history.

(56) References Cited

U.S. PATENT DOCUMENTS

| | | | | |
|---|---|---|---|---|
| 3,004,389 | A * | 10/1961 | Muller | 60/369 |
| 5,177,964 | A * | 1/1993 | Tanaka et al. | 60/445 |
| 5,540,295 | A * | 7/1996 | Serrette | 175/56 |
| 5,865,602 | A * | 2/1999 | Nozari | 417/44.1 |
| 7,598,640 | B2 | 10/2009 | Heichel et al. | |
| 7,740,085 | B2 * | 6/2010 | Roussy | 173/49 |
| 8,316,983 | B2 * | 11/2012 | Shirao | 180/305 |
| 8,336,643 | B2 * | 12/2012 | Harleman | 175/56 |
| 8,739,906 | B2 * | 6/2014 | Kawashima | 180/65.22 |
| 2009/0007559 | A1 * | 1/2009 | Dazin | 60/445 |
| 2009/0145122 | A1 * | 6/2009 | Deeken | F04B 49/002 60/451 |
| 2009/0189467 | A1 * | 7/2009 | Heichel et al. | 310/81 |
| 2012/0060777 | A1 * | 3/2012 | Tikkanen et al. | 123/41.11 |
| 2013/0336812 | A1 * | 12/2013 | Buecker et al. | 417/213 |

FOREIGN PATENT DOCUMENTS

| | | | | |
|---|---|---|---|---|
| DE | 20 2007 005 283 | | 7/2007 | |
| EP | 0 951 949 | | 10/1999 | |
| EP | 2 014 835 | | 1/2009 | |
| EP | 2 085 149 | | 8/2009 | |
| JP | WO2010147121 | * | 12/2010 | B60K 6/42 |
| WO | WO2010116853 | * | 10/2010 | F16H 61/425 |

* cited by examiner

*Primary Examiner* — Nathaniel Wiehe
*Assistant Examiner* — Dustin T Nguyen
(74) *Attorney, Agent, or Firm* — Collard & Roe, P.C.

(57) ABSTRACT

A device having a hydraulic drive for civil engineering work has least one shaft that can be rotated by a hydraulic motor. The hydraulic motor is operated by fluid of a hydraulic circuit that is supplied by a hydraulic pump. The hydraulic motor has a changeable displacement, and means for changing the volume stream are provided. A sensor for measuring the fluid pressure is disposed in the hydraulic circuit, and is connected with a control and regulation unit, by way of which the displacement of the hydraulic motor is adjustable, and by way of which the means for a change in the volume stream can be turned on. The control and regulation unit is set up so that in the event of a pressure drop in the hydraulic circuit, a reduction in the displacement of the hydraulic motor as well as a reduction in the volume stream is brought about.

3 Claims, 2 Drawing Sheets

DEVICE HAVING A HYDRAULIC DRIVE FOR CIVIL ENGINEERING

CROSS REFERENCE TO RELATED APPLICATIONS

Applicants claim priority under 35 U.S.C. §119 of European Application No. 11006636.2 filed Aug. 12, 2011, the disclosure of which is incorporated by reference.

BACKGROUND OF THE INVENTION

1. Field of the Invention

The invention relates to a device having a hydraulic drive for civil engineering work, particularly a pile-driving or drilling. The invention also relates to a method for operation of a device having a hydraulic drive for civil engineering work, particularly of a pile-driving or drilling device.

2. The Prior Art

In construction, different devices having a hydraulic drive for civil engineering work are operated in a hydraulic group. The hydraulic group generally consists of a hydraulic pump, preferably having a changeable displacement (adjustable pump), which is driven by a drive motor, for example an internal combustion engine, a work device having a hydraulic drive, for example a hydraulic motor, as well as a control or regulation unit. The hydraulic group is operated with a fluid in a hydraulic circuit. The product of pressure and volume stream of the fluid yields the hydraulic power.

Vibration pile-drivers, for example are used as work devices to introduce objects, such as, for example, profiles, into the ground or to pull them out of the ground, or also to compact ground material. The ground is excited by means of vibrations and thereby achieves a "pseudo-liquid" state. By means of a static top load, the goods to be pile-driven can then be pressed into the construction ground. Vibration pile-drivers generally have vibration exciters that act in linear manner, whose centripetal force is generated by means of rotating imbalances. The progression of the speed of the linear vibration exciter corresponds to a periodically recurring function, for example a sine function.

The vibration exciters are operated with hydraulic rotary drives, which put the shafts on which the imbalances are disposed into rotation. The required drive power can differ significantly during operation. For example, different ground composition properties or different goods to be pile-driven require different drive powers. In idle, on the other hand, the required drive power is very low. There are frequent situations in which the maximal power offered by the hydraulic circuit is not required or cannot be implemented. In the case of conventional vibration exciters having hydraulic motors, which do not have a changeable displacement (constant motors), the work pressure drops at a constant volume stream, while the power losses in the hydraulic circuit, which are dependent on the volume stream, remain constant.

In the case of vibration exciters having hydraulic motors with a changeable displacement (adjustable motors), operation in different speed of rotation ranges, without a power drop, is possible, as is known to a person skilled in the art from European Patent Application No. EP 2085149 A1.

Other devices used in construction, having a hydraulic drive, are so-called drilling devices. These are used, among other things, for the production of pile foundations, for example drilled piles and concrete piles for increasing the bearing capacity of the construction ground or for ground replacement measures. The drilling drives connected with the drilling device are generally hydraulic rotational drives, to which a drill pipe or drilling tools is/are attached.

SUMMARY OF THE INVENTION

It is an object of the present invention to provide a device having a hydraulic drive for civil engineering, in which the degree of effectiveness is increased. According to the invention, this task is accomplished by a device having a hydraulic drive for civil engineering work, particularly a pile-driving or drilling device, which demonstrates a higher degree of effectiveness. It has turned out that it is practical, in terms of energy, to reduce the hydraulic volume stream in the event of a reduced power demand, instead of the pressure. By providing a control and regulation unit that is set up in such a manner that in the event of a pressure drop in the hydraulic circuit, a reduction in the volume stream is brought about, the drive of the work device is operated with less fluid, at the same speed of rotation, when maximal power is not required. For this purpose, the power of the drive motor that is being requested is reduced, thereby reducing diesel consumption as well as noise emissions. Furthermore, lesser cooling power is required for the reduced volume stream, thereby further lowering the energy demand. Last but not least, wear of the drive of the work device is reduced.

Conventional drilling devices drive the work device with hydraulic motors that either have an unchangeable displacement (constant motor) or whose changeable displacement (adjustable motor) can be adjusted to multiple values that are predetermined in a fixed manner. In the case of constant motors, the maximal motor speed of rotation results from the volume stream offered in the hydraulic circuit, whereby usually, the available pressure at a maximal volume stream is slightly less than the maximal pressure, which is generally permitted over a broad range of speed of rotation, up to just below the maximal speed of rotation.

In general, the torque required for drilling increases, for example due to growing mantle friction, with an increasing depth. At the beginning of drilling, more or less in idle, the device is operated at the maximal speed of rotation, but works at very low pressure, because of the very low load. The power that results from the volume stream and the pressure is low; the power loss, which results from the volume stream independent of the pressure, already reaches its maximal value. With an increasing mantle friction, the power implemented at the work device increases with the pressure; the power loss remains approximately the same. When the pressure available at the maximal conveyance amount is reached, the speed of rotation of the work device decreases; the pressure continues to increase. If the speed of rotation of the device decreases further after the permissible maximal pressure is reached, the pressure remains constant; the volume stream offered in the hydraulic circuit is reduced. As a result, the power offered in the hydraulic circuit can be called up just as little as in the case of maximal volume stream and low pressure.

If the displacement of a device having an adjustable motor is adjusted, step by step, to values that are predetermined in fixed manner, it is possible to react better to changing requirements; fundamentally, however, such a drive behaves in the same way as a constant motor, just with certain gradations that are predetermined.

If the device is driven by an adjustable motor, at a low load, either a higher speed of rotation can be achieved by reducing the displacement, and drilling can take place faster, or the power loss that results from flow resistances is reduced by a simultaneous reduction of the volume stream. Along the characteristic line of the hydraulic circuit (usually, the pressure that can be achieved is represented as a function of the volume stream), there is a range in which the product of pressure (or difference pressure at the hydraulic motor) and volume stream reaches a maximum. In order to achieve the maximal work power, the drilling device should be operated in this range of the maximally available power. The volume stream of the hydraulic circuit can be predetermined by means of corresponding adjustments of the pump, for example by a change in the speed of rotation of the drive motor and/or a changed displacement of the pump. The displacement of the adjustable motor is adjusted as a function of the pressure, so that the work device is always operated in the range of maximal power. At a high load, the speed of rotation of the work device will be lower than at a low load. If the power is not needed, the displacement of the adjustable motor and the volume stream should be reduced simultaneously, so that the optimal pressure is maintained and the losses in the hydraulic circuit are reduced to a minimum.

In order to achieve the operating states described, the displacement of the adjustable motor as well as the volume stream must be regulated as a function of the pressure. The present invention makes it possible, on the one hand, to call up the offered power in the most varied operating situations; on the other hand, the power loss can be reduced at a lower power demand.

The "displacement" of a hydraulic motor or of a hydraulic pump is understood to mean the amount of hydraulic fluid that is put through during rotation. While in the case of conventional hydraulic motors having a fixed displacement, a reduction in the speed of rotation is only possible by way of a reduction in the volume stream, thereby simultaneously reducing the power of the motor. The speed of rotation can be reduced, in the case of a hydraulic motor having a changeable displacement, at a constant volume stream, by means of a change in the displacement; thereby simultaneously increasing the torque of the engine, while the power remains constant.

In the case of a reduced power demand, it is possible to reduce the volume stream, with a hydraulic motor having a changeable displacement, at a reduced displacement and at the same pressure, and thus to reduce the losses in the hydraulic group to a minimum. In other words, at a constant pressure setting, the power can be adjusted by way of the volume stream that is made available by the hydraulic pump, at a constant speed of rotation of the hydraulic motor.

In a further development of the invention, the means for a change in the volume stream are formed by a drive motor which drives the pump. To reduce the volume stream, the speed of rotation of the drive motor can be reduced by way of the control and regulation unit. By reducing the motor speed of rotation, the fuel consumption is minimized, and the noise emissions induced by the motor are reduced.

Alternatively or in combination, the hydraulic pump has a variable displacement, thereby forming means for a change in the volume stream, whereby the displacement of the hydraulic pump can be reduced by way of the control and regulation unit, to reduce the volume stream.

The present invention also includes a method for operation of a device having a hydraulic drive for civil engineering work, particularly of a pile-driving or drilling device, comprising at least one hydraulic motor having a changeable displacement, which is operated by way of a fluid of a hydraulic circuit, which is supplied by way of a pump. The method allows a higher degree of effectiveness of the work device. According to the invention, in the event of a pressure drop in the hydraulic circuit, the displacement of the hydraulic motor as well as the fluid volume stream is reduced.

With the invention, a method for operation of a device having a hydraulic drive is created, which method allows an increase in the power transfer or reduces the losses of the hydraulic group to a minimum.

In a further development of the invention, the hydraulic pump is driven by way of a drive motor, whereby the reduction in the volume stream takes place by means of a reduction in the speed of rotation of the motor. In this way, a reduction in fuel consumption as well as of the noise emissions initiated by the motor is achieved.

In a further embodiment of the invention, a hydraulic pump having a changeable displacement is used, whereby the reduction in the volume stream takes place by a reduction of the displacement of the pump.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
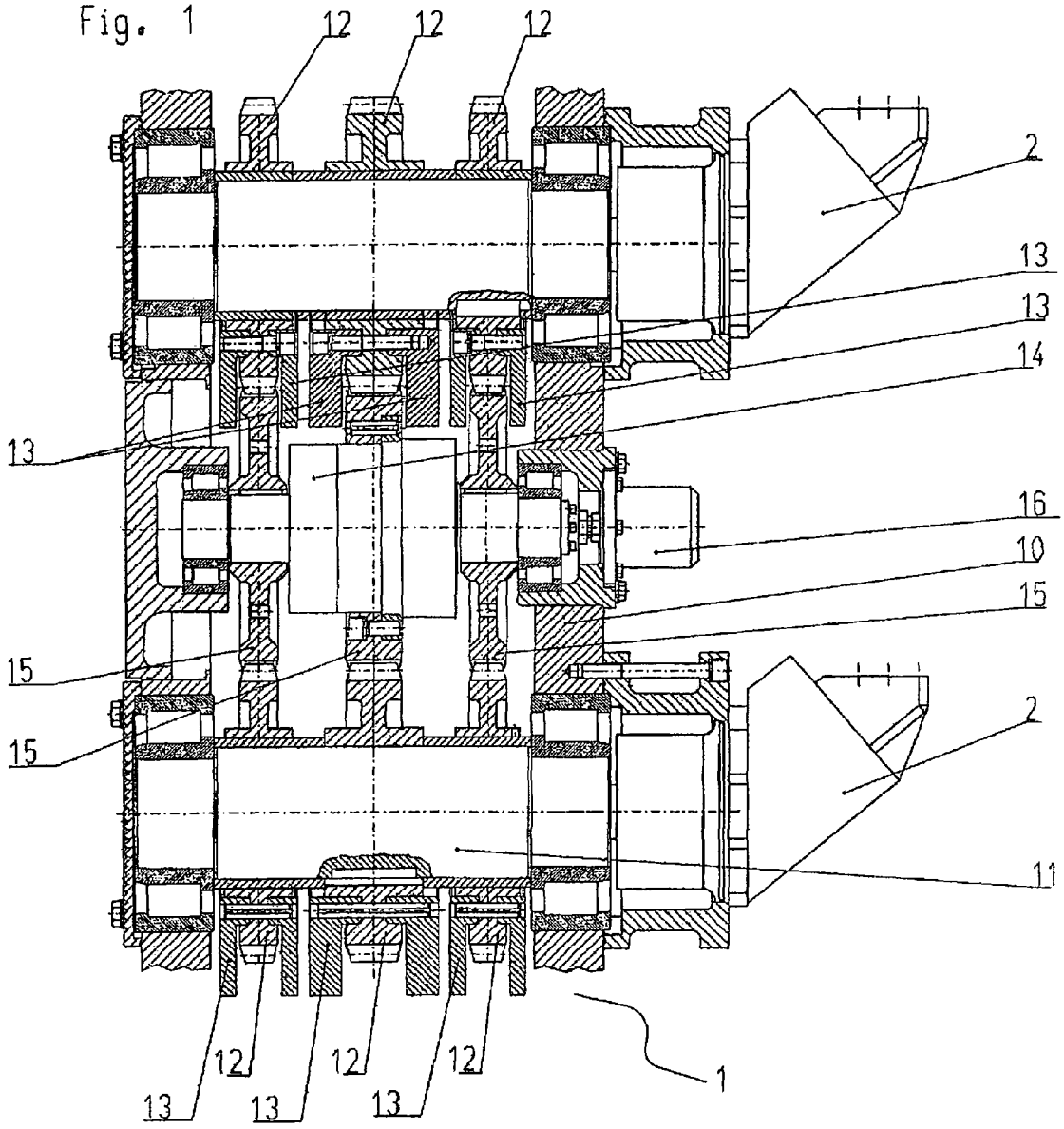
FIG. 1 shows a schematic representation of a vibration generator of a vibration pile-driver in longitudinal section.

Referring now in detail to the drawings, a vibration generator 1 of a vibration pile-driver (not shown) consists essentially of a housing 10, in which drive shafts 11 provided with gear wheels 12 are mounted so as to rotate. The gear wheels 12 are each provided with imbalance masses 13, whereby the gear wheels 12 of the two drive shafts 11 engage the rotor shaft 16 of a pivot motor 14, by way of gear wheels 15. The gear wheels 12, provided with imbalance masses 13, are adjustable relative to one another by way of the pivot motor 14, in terms of their rotational position, and as a result, the resulting imbalance, in other words the resulting static moment, is adjustable. The drive shafts 11 are each connected with a hydraulic motor 2, by way of which they can be driven. Such vibrator gear mechanisms are known to a person skilled in the art, for example from German Patent Application No. DE 20 2007 005 283 U1.

Figure 2:
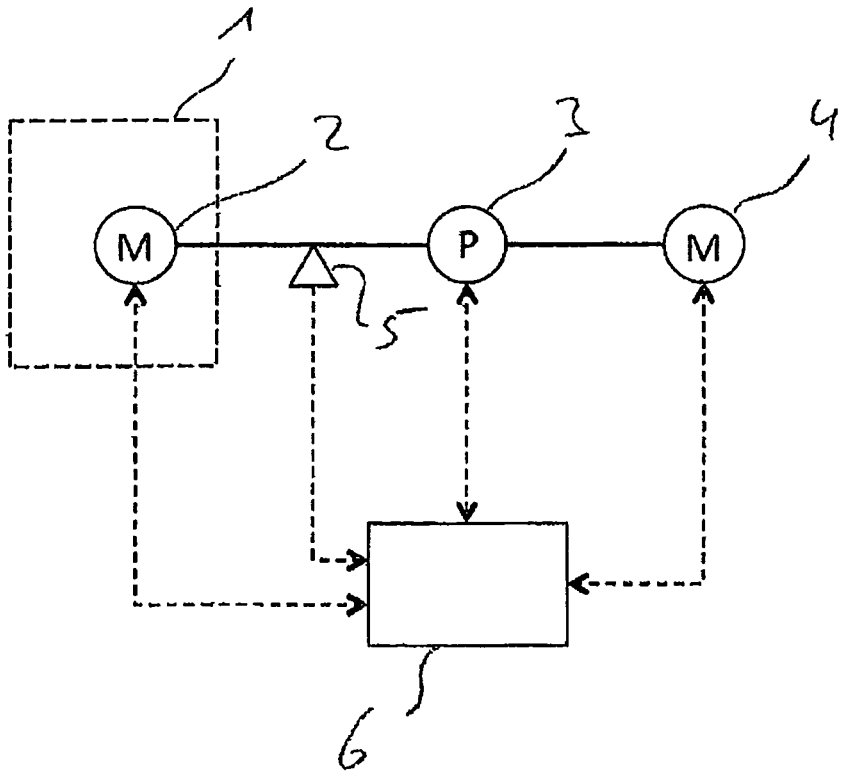
FIG. 2 shows a schematic representation of the hydraulic circuit of the hydraulic drive of the vibration generator according to FIG. 1.

In FIG. 2, the hydraulic circuit for a hydraulic motor 2 of the vibration generator 1 is shown in fundamental terms. The hydraulic motor 2 has a changeable displacement and is supplied by way of an adjustable pump 3 that is driven by way of a drive motor 4. A pressure sensor 5 is disposed in the hydraulic circuit, ahead of the hydraulic motor 2, which sensor is connected with a control and regulation device 6. The control and regulation device 6 is set up in such a manner that in the event of a pressure drop in the hydraulic circuit, a reduction in the displacement of the hydraulic motor 2 as well as a reduction in the volume stream is brought about. For this purpose, the control and regulation device 6 is connected not only with the adjustable pump 3 but also with the drive motor 4. It is adjustable, in the control and regulation device 6, to what proportion the required reduction of the volume stream is brought about by a reduction in the displacement of the adjustable pump 3 or by means of a reduction in the speed of rotation of the drive motor 4. Of course, the reduction in the volume stream is also possible only by a reduction of the displacement of the adjustable pump 3 or only by a reduction in the speed of rotation of the drive motor 4.

During operation of the vibration generator 1, the pressure of the hydraulic circuit ahead of the hydraulic motor 2 is continuously detected by way of the pressure sensor 5 and reported to the control and regulation device 6. If a pressure drop is detected, which can be caused, for example, by a change in the ground composition and in the reduced power demand connected with that, or also by a rest phase in work operation, the speed of rotation of the drive motor 4 is reduced and/or the displacement of the adjustable pump 3 is reduced. At the same time, the displacement of the hydraulic motor 2 is reduced by way of the control and regulation device 6, in such a manner that the speed of rotation of the hydraulic motor 2 remains constant. If the pressure sensor 5 indicates a pressure increase in the hydraulic circuit, which is regularly caused by an increased power demand, the speed of rotation of the drive motor 4 is increased and/or the displacement of the adjustable pump 3 is increased, whereby at the same time, the displacement of the hydraulic motor 2 is increased to such an extent that the speed of rotation continues to remain constant. In this manner, the power of the vibration generator is adjustable by way of the volume stream that is made available by the adjustable pump 3, in accordance with the power being called for. This method can be equally transferred to the operation of other work devices having hydraulic drives, such as drilling devices, for example.

Accordingly, while only a few embodiments of the present invention have been shown and described, it is obvious that many changes and modifications may be made thereunto without departing from the spirit and scope of the invention.

What is claimed is:

1. A method for operation of a pile driving or drilling device having a hydraulic drive, the device comprising at least one hydraulic motor having a changeable displacement, which is operated by way of a fluid of a hydraulic circuit, which is supplied by way of a hydraulic pump connected to a drive motor, the method comprising reducing a displacement of the hydraulic motor as well as controlling the hydraulic pump or drive motor to effect a reduction in a volume stream of the hydraulic circuit to reduce energy losses in the hydraulic circuit during operation of the pile driving device in the event of a pressure drop in the hydraulic circuit, and maintaining a constant speed of the hydraulic motor.

2. The method according to claim 1, wherein the step of reducing the volume stream takes place by reducing a speed of rotation of the drive motor.

3. The method according to claim 1, wherein a hydraulic pump having a changeable displacement is used, wherein the step of reducing the volume stream takes place by reducing the displacement of the pump.

* * * * *